US005257712A

United States Patent [19]

Minichshofer et al.

[11] Patent Number: 5,257,712

[45] Date of Patent: Nov. 2, 1993

[54] APPARATUS FOR APPLYING A NON-WOVEN WEB TO A CONCURRENTLY MOVING CARRIER WEB

[75] Inventors: Klaus Minichshofer, Linz; Peter Müller, Marchtrenk; Hannes Pum, Wels, all of Austria

[73] Assignee: Textilmaschinenfabrik Dr. Ernst Fehrer Aktiengesellschaft, Leonding, Austria

[21] Appl. No.: 945,839

[22] Filed: Sep. 16, 1992

Related U.S. Application Data

[63] Continuation of Ser. No. 729,856, Jul. 11, 1991, abandoned, which is a continuation of Ser. No. 436,435, Nov. 14, 1989, abandoned.

[30] Foreign Application Priority Data

Nov. 22, 1988 [AT] Austria ..... 2860/88

[51] Int. Cl.[5] ..... B65H 20/00

[52] U.S. Cl. ..... 226/108; 226/24; 226/45; 226/30; 250/561; 250/571

[58] Field of Search ..... 226/24, 25, 42, 45, 226/108, 30; 242/75.5, 75.52, 75; 250/561, 571

[56] References Cited

U.S. PATENT DOCUMENTS

| | | | |
|---|---|---|---|
| 3,104,790 | 9/1963 | DeHaven | 226/170 X |
| 3,871,290 | 3/1975 | Verboom | 242/562 X |
| 4,445,044 | 4/1984 | Buess | 242/75.52 X |
| 4,848,634 | 7/1989 | Crowley et al. | 226/45 X |
| 4,849,644 | 7/1989 | Mira et al. | 250/561 |
| 4,916,324 | 4/1990 | Meier | 250/561 |

FOREIGN PATENT DOCUMENTS

| | | | |
|---|---|---|---|
| 0684234 | 12/1952 | United Kingdom | 226/30 |

*Primary Examiner*—Daniel P. Stodola
*Assistant Examiner*—Paul T. Bower
*Attorney, Agent, or Firm*—Collard & Roe

[57] ABSTRACT

In an apparatus for applying a non-woven web to a moving carrier web, a straight configuration of the longitudinal edges of the non-woven web being applied to the carrier web is obtained by controlling the feeding speed of the feeder for the non-woven web in dependence on the distance between the carrier web and an unguided course of the non-woven web extending between the carrier web and a preceding fixed guide leading the non-woven web to the carrier web.

8 Claims, 1 Drawing Sheet

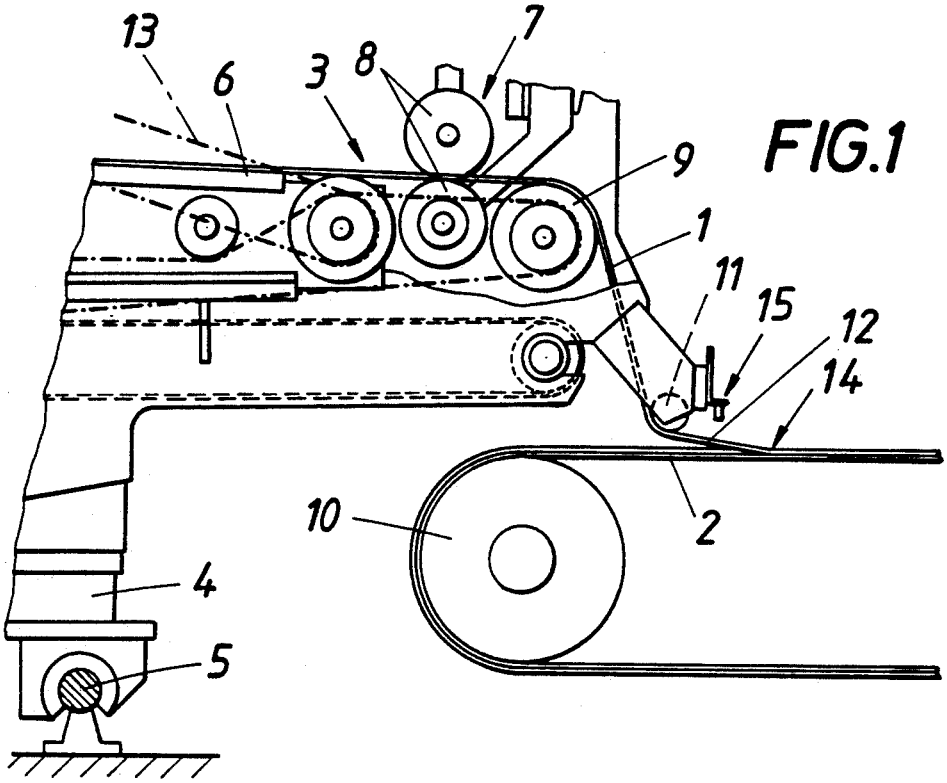
FIG.1
FIG.2
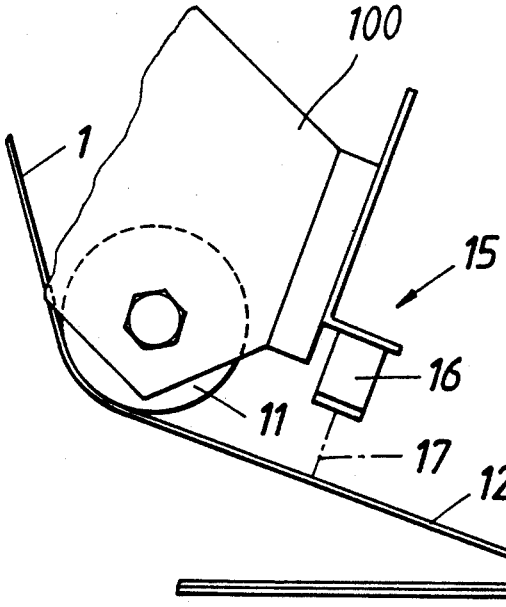
FIG.3
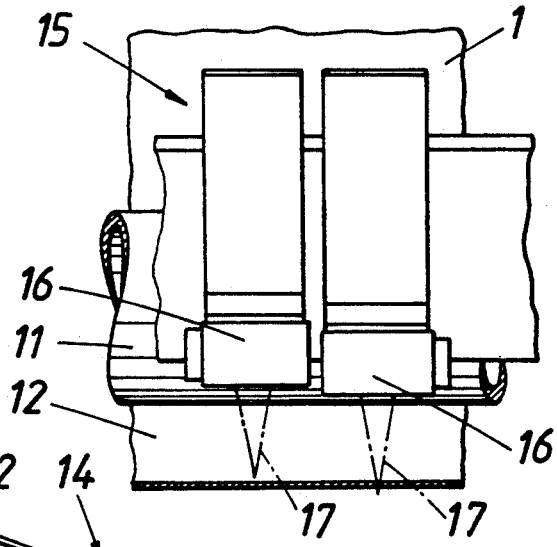

APPARATUS FOR APPLYING A NON-WOVEN WEB TO A CONCURRENTLY MOVING CARRIER WEB

CROSS-REFERENCE TO RELATED PATENT APPLICATIONS

This is a continuation of copending patent application Ser. No. 729,856 filed Jul. 11, 1991, now abandoned, which in turn is a continuation of co-pending Ser. No. 436,435 filed Nov. 14, 1989, now abandoned.

BACKGROUND OF THE INVENTION

1. Field of the Invention

This invention relates to an apparatus for applying a non-woven web to a moving carrier web, comprising a feeder for feeding the non-woven web at a controllable feeding speed.

2. Description of the Prior Art

It may be desired to apply a non-woven web in a plurality of juxtaposed convolutions to a carrier web, which is usually endless and revolving, and the several convolutions may be desired to exactly adjoin each other or to overlap each other in a predetermined width. In that case that portion of the non-woven web which is being fed to the carrying web must have at least approximately straight longitudinal edges. For that purpose the non-woven web is trimmed at its longitudinal edges before the non-woven web is applied to the carrier web. But it has been found in practice that such edge trimming of the non-woven web which is moving toward the carrier web will not be sufficient to ensure that the non-woven web which has been deposited on the carrier web has straight edges. This is due to the fact that the external loads applied to the non-woven web and its inherent stresses may result in a non-predictable distortion of the non-woven web because the latter has only a low intrinsic strength.

SUMMARY OF THE INVENTION

For this reason it is an object of the invention to avoid said disadvantages and to provide an apparatus which can be used to apply a non-woven web with straight longitudinal edges to a moving carrier web.

In an apparatus which is of the kind described first hereinbefore and serves to apply a non-woven web to a carrier web moving in the same direction that object is accomplished in accordance with the invention by controlling the feeding speed of the feeder for the non-woven web in dependence on the distance between the carrier web and an unguided course of the non-woven web extending between the carrier web and preceding guiding means.

The invention is based on the recognition that, when an edge-trimmed course of the non-woven web is fed to the carrier web, it may be subjected to a tensile stress which will determine the configuration of its longitudinal edges and may compensate for the inherent stresses existing in said non-woven web so that the course will be subjected to a uniform tensile stress and as a result will reliably have straight longitudinal edges. That stress will be applied to the course of the non-woven web as it is entrained by the carrier web against the resistance presented by the feeder and can be controlled by a control of the ratio of the speed at which the non-woven web is fed by the feeder and the speed at which the non-woven web is entrained by the carrier web. But it must be borne in mind that the tensile stress which is produced when said course of said non-woven web is pulled from the feeder by the carrier web cannot be measured in said course of non-woven web so that the means usually employed to measure tensile stresses in a web cannot be used in that case because they cannot perform a non-contacting measurement of the tensile stresses and the non-woven web has such a low intrinsic strength that an additional stress by such measuring means would not be permissible. For this reason it is proposed by the invention that the distance between said course of the non-woven web and the carrier web is used as a measure of the effective tensile stresses when said course is not guided between the carrier web and guiding means which precede the carrier web. Such a determination can simply be effected in a non-contacting manner with an adequate accuracy. Upon an increase of the tensile stress the point at which said course of the non-woven web first contacts the carrier web will move further away from the guiding means. Upon a decrease of the tensile stress that point of initial contact will move closer to the guiding means. The distance between the carrier web and the unguided course of the non-woven web will similarly increase or decrease. It is apparent that changes of the distance between the carrier web and the unguided course of the non-woven web extending between the carrier web and the preceding guiding means will reflect changes of the tensile stress in said course of the non-woven web and the determination of said distance may be used for an automatic control of the feeding speed of the feeder by a comparison of desired and actual values. As a result, the said course of the non-woven web will be delivered with straight longitudinal edges to the carrier web.

In accordance with a further feature of the invention the changes of the distance of the unguided course of the non-woven web from the carrier web may be effected by the provision of at least one sensor for measuring the distance between a point of reference and a portion of said unguided course of the non-woven web, which portion is disposed between the delivery end of the guiding means and the carrier web because the distance to be measured will be reflected with adequate accuracy from the position of a portion of the unguided course of the non-woven web and a stationary point of reference. In such case a particularly simple design will be obtained if the point of reference is constituted by the sensor and it will be sufficient for the desired result to detect the deviation of said unguided course of the non-woven web from a desired position and to return the non-woven web to its desired position in dependence on that detection.

This can be accomplished with two sensors for detecting a deviation of the distance from an upper limit and a lower limit, respectively, so that the sense of the deviation can be detected in a simple manner. The same object can be accomplished by the provision of a single sensor, e.g., if the sensor comprises a receiver for a light ray which has been reflected from the surface of the unguided course of the non-woven web, if the deflection of that light ray is detected, which deflection will depend on the distance from the sensor to the illuminated surface of the unguided course of the non-woven web. That deflection will indicate not only the amount of the change of the distance but also the direction of said change.

BRIEF DESCRIPTION OF THE DRAWING

FIG. 1 is a diagrammatic side elevation showing an apparatus in accordance with the invention for applying a non-woven web to a concurrently moving carrier web.

FIG. 2 is an enlarged and simplified side elevation showing a device for detecting changes of the position of the unguided course of the non-woven web.

FIG. 3 is a front elevation showing the apparatus of FIG. 2.

DETAILED DESCRIPTION OF THE PREFERRED EMBODIMENT

An illustrative embodiment of the invention will now be described more in detail with reference to the drawing.

The apparatus which is illustrated by way of example in FIG. 1 and serves for applying a non-woven web 1 to a concurrently moving carrier web 2 comprises a feeder 3 for the non-woven web. That feeder is mounted on a carriage 4, which is reciprocable over the width of the carrier web 2 on a slide track 5, which is transverse to the carrier web 2. A device for unwinding the non-woven web from a roll thereof is associated with the feeder 3 and is not shown for the sake of clearness. The non-woven web is unwound from such roll and is fed by a belt conveyor 6 to an edge-trimming device 7, which comprises laterally disposed cutter disks 8 for trimming the non-woven web 1 at its longitudinal edges. The edge-trimmed non-woven web 1 is then delivered over a delivery roller 9 to the endless carrier web 2, which revolves around reversing pulleys 10. During delivery to the carrier web 2, the edge-trimmed non-woven web is guided by guiding means 11 mounted on a support means 100, which deflect the non-woven web and consist of a roller, a rod or a tube. As a result the non-woven web has between the carrier web 2 and the preceding guiding means 11 an unguided course 12 and the distance from said course to the carrier web 2 will depend on the tensile stresses which are due to the fact that the non-woven web is pulled by the carrier web 2 from the feeder 3 so that the non-woven web can then continually be needled onto the carrier web 2. Said tensile stresses will be determined by the ratio of the feeding speed of the feeder 3 and the speed at which the non-woven web is pulled, which latter speed is determined by the speed at which the carrier web 2 revolves. Said tensile stresses may be controlled by a control of that speed ratio by correspondingly adjusting the feeding speed of the feeder 3. The feeding speed of the feeder 3 will depend on the speed at which the belt conveyor 6 revolves and on the speed of the delivery roller 9, which is operatively connected to the belt conveyor 6 and together with the belt conveyor is driven by a chain drive 13 from a controllable conveyor drive, which is not shown.

For an adjustment and control of the tensile stresses which are required to ensure a straight configuration of the longitudinal edges of the non-woven web 1, the distance of the unguided course 12 of the non-woven web extending between the guiding means 11, which directly precedes the carrier web 2, and the point 14 at which the non-woven web 1 initially contacts the carrier web 2, is monitored by a non-contacting device 15 for detecting the position of the unguided course 12 of the non-woven web. In the illustrated embodiment that apparatus comprises two sensors 16 mounted on the support means 100 and fixed with respect to the guiding means, each of which comprises a receiver for a light ray 17, which has been reflected by the surface of the course 12 of the non-woven web. Said sensors define or measure an upper limit and a lower limit, respectively, for the position of the course 12 of the non-woven web. If the position of the course 12 of the non-woven web is outside the range defined by said two limits, the resulting change of the deviation of the deflected light ray 17 will result in response of that sensor 16 which has been adjusted to the limit which has been exceeded and said sensor will then deliver a control signal for adjusting the conveyor drive for the feeder 3 in the sense of a return of the course 12 of the non-woven web to the range of desired positions. As a result, uniform tensile stress conditions in that course of the non-woven web which is delivered to the carrier web can be ensured. This is an essential requirement for an application of the non-woven web 1 with straight longitudinal edges to the carrier web 2.

The two sensors are vertically above the web and each sensor directs a light ray vertically downward perpendicularly onto the web. The ray is reflected vertically upward to a receiver vertically above the web.

The upper and lower limits of the desired positions of the course 12 of the non-woven web should be predetermined and adjusted in dependence on the conditions existing in each case. The sensors themselves need not be changed for a corresponding adjustment but it will be possible to maintain the sensors adjusted to the predetermined limits and to adjust the position of the sensors so that the distances from the sensors to the desired position of the course of the non-woven web correspond to the adjusted limits.

It will be understood that the invention is not restricted to the embodiment shown by way of example. For instance, different sensors may be used to detect the position of the course 12 of the non-woven web because it is necessary to detect the position of the course of the non-woven web regardless of the means by which the position of the course 12 of the non-woven web is detected.

We claim:

1. In an apparatus for applying a non-woven web to a moving carrier web, comprising means for moving a carrier web to move an upwardly facing surface of said carrier web along a predetermined path, and a feeder for moving a non-woven web at a controllable feeding speed toward said path, said non-woven web having a first side longitudinal edge and having a second side longitudinal edge;

the improvement comprising a laterally disposed cutter disk on each side of the non-woven web for trimming each longitudinal edge of said non-woven web;

guiding means fixedly spaced above said carrier web for receiving said non-woven web from said feeder and for delivering an unguided course of said non-woven web to said path, with a portion of said unguided course overlying and spaced from said path;

sensor means for detecting the distance of said overlying portion from said path;

support means for fixedly supporting said sensor means with respect to said guiding means; and means for controlling said feeding speed so as to maintain said distance in a predetermined range.

2. The improvement set forth in claim 1, wherein said sensor means comprise at least one sensor for detecting the distance of said portion of said unguided course from a point of reference, which is spaced a predetermined distance from said path.

3. The improvement set forth in claim 2, wherein said point of reference is defined by said sensor.

4. The apparatus according to claim 1, wherein each sensor means comprises a light source vertically above the web for directing a light ray vertically downward perpendicularly onto the web; and a receiver vertically above the web for receiving the light ray reflected vertically upwardly.

5. In an apparatus for applying a non-woven web to a moving carrier web, comprising:

means for moving a carrier web to move an upwardly facing surface of said carrier web along a predetermined path;

a feeder for moving a non-woven web at a controllable feeding speed toward said path, said non-woven web having a first side longitudinal edge and having a second side longitudinal edge;

the improvement comprising a laterally disposed cutter disk on each side of the non-woven web for trimming each longitudinal edge of said non-woven web;

guide means fixedly spaced above said carrier web for receiving said non-woven web from said feeder and delivering an unguided course of said non-woven web to said path, with a portion of said unguided course overlying and spaced from said path;

sensor means for detecting the distance of said overlying portion from said path;

means for controlling said feeding speed so as to maintain said distance in a predetermined range;

support means for fixedly supporting said sensor means with respect to said guiding means;

wherein said sensor means comprises two non-contacting sensors for detecting the distance of said portion of said unguided course from said path;

said sensors measure an upper limit and measure a lower limit, respectively of said range; and said controlling means are arranged to change said feeding speed in response to a change of said distance beyond one of said limits when such change has been detected by one of said sensors.

6. The apparatus according to claim 5, wherein each sensor means comprises a light source vertically above the web for directing a light ray vertically downward perpendicularly onto the web; and a receiver vertically above the web for receiving the light ray reflected vertically upwardly.

7. An apparatus for applying a non-woven web to a moving carrier web, comprising:

means for moving a carrier web to move an upwardly facing surface of said carrier web along a predetermined path;

a feeder for moving a non-woven web at a controllable feeding speed toward said path, said non-woven web having a first side longitudinal edge and having a second side longitudinal edge;

the improvement comprising a laterally disposed cutter disk on each side of the non-woven web for trimming each longitudinal edge of said non-woven web;

guiding means fixedly spaced above said carrier web for receiving said non-woven web from said feeder and delivering an unguided course of said non-woven web to said path, with a portion of said unguided course overlying and spaced from said path;

sensor means for detecting the distance of said overlying portion from said path;

support means for fixedly supporting said sensor means with respect to said guiding means;

means for controlling said feeding speed so as to maintain said distance in a predetermined range;

wherein said sensor means comprises two non-contacting sensors for detecting the distance of said portion of said unguided course from said path;

said sensors measure an upper limit and measure a lower limit, respectively, of said range;

said non-woven web having a light-reflective surface wherein each of said sensors comprises a light source for directing a light ray onto said light-reflective surface at said overlying portion of said unguided course and a receiver for receiving reflected light from said light-reflective surface and for detecting the deflection of said reflected light; and said controlling means are arranged to change said feeding speed in response to a change of said distance beyond one of said limits when such change has been detected by one of said sensors.

8. The apparatus according to claim 7, wherein each sensor means comprises a light source vertically above the web for directing a light ray vertically downward perpendicularly onto the web; and a receiver vertically above the web for receiving the light ray reflected vertically upwardly.

* * * * *